US006764249B2

(12) United States Patent
Stone

(10) Patent No.: US 6,764,249 B2
(45) Date of Patent: Jul. 20, 2004

(54) TEMPORARY PAVEMENT MARKER

(76) Inventor: Mary Anna Jane Stone, 15 Bevan Rd., Garden Valley, ID (US) 83622

( * ) Notice: Subject to any disclaimer, the term of this patent is extended or adjusted under 35 U.S.C. 154(b) by 0 days.

(21) Appl. No.: 10/322,389

(22) Filed: Dec. 17, 2002

(65) Prior Publication Data

US 2004/0114997 A1 Jun. 17, 2004

(51) Int. Cl.[7] ..... E01F 9/06
(52) U.S. Cl. ..... 404/16; 116/63 R
(58) Field of Search ..... 404/6, 9, 10, 11, 404/12, 13, 14, 15, 16; 116/63 R, 63 P

(56) References Cited

U.S. PATENT DOCUMENTS

| | | | | | |
|---|---|---|---|---|---|
| 3,785,719 | A | * | 1/1974 | Jonnes | 359/538 |
| 3,864,052 | A | | 2/1975 | Blomberg | 404/94 |
| 3,879,148 | A | * | 4/1975 | Eigenmann | 404/10 |
| 4,145,152 | A | | 3/1979 | Waugh | 404/71 |
| 4,462,711 | A | * | 7/1984 | Garner | 404/10 |
| 4,618,281 | A | * | 10/1986 | Ajemian | 404/16 |
| 5,136,475 | A | * | 8/1992 | McDermott | 362/158 |
| 5,165,818 | A | * | 11/1992 | Newhart | 404/10 |
| 5,391,015 | A | | 2/1995 | Kaczmarczik et al. | 404/14 |
| 5,393,166 | A | * | 2/1995 | Stock et al. | 404/14 |
| 5,460,115 | A | * | 10/1995 | Speer et al. | 116/63 P |
| 5,555,778 | A | * | 9/1996 | Otters et al. | 81/3.55 |
| 5,788,405 | A | * | 8/1998 | Beard | 404/10 |
| 6,505,994 | B1 | * | 1/2003 | Attar | 404/16 |
| 2002/0124448 | A1 | * | 9/2002 | Seville | 40/607 |

OTHER PUBLICATIONS

Bunzl Extrusion Website; 2 Pages; Printed Sep. 5, 2002; http://www.davidsonplastics.net/highway/trpm_s.htm.
Davidson Traffic Control Products; 1 Page.

* cited by examiner

*Primary Examiner*—Robert E. Pezzuto
*Assistant Examiner*—Alexandra K. Pechhold
(74) *Attorney, Agent, or Firm*—Frank J. Dykas; Derek H. Maughan; Dykas, Shaver & Nipper

(57) ABSTRACT

A temporary road maker is provided with one or more transparent protective covers covering a reflection of the road marker, wherein each protective cover is provided with a separate pull-tab located at a unique location with reference to the pull-tabs of other protective covers to facilitate the rapid removal of the outermost protective cover whenever said protective cover is coated with road resurfacing material and thereby is obscuring the reflective portion of the temporary road marker.

3 Claims, 2 Drawing Sheets

TEMPORARY PAVEMENT MARKER

DESCRIPTION

BACKGROUND OF THE INVENTION

1. Field of the Invention

The present invention generally relates to an improved temporary pavement marker for use in providing short-term temporary road markers during road resurfacing, and more particularly relates to an improved temporary pavement marker having one or more clear, removable protective covers covering a reflective surface wherein each clear, removable protective cover has a unique pull-tab to facilitate quick and easy removal.

2. Background Information

Periodic road maintenance normally includes pavement resurfacing using either a chip, slurry, or road seal compound that is applied over the original surface in order to restore and protect it. When this is done, the existing painted traffic lines, be they centerlines, passing lines, no passing lines, turn lane lines, or any other traffic painted line will be covered and thereby obliterated and no longer visible.

In order to preserve the accurate location and type designation of these lines, temporary pavement markers are first installed on the road surface prior to any road coating operation. These temporary pavement markers are typically formed of a resilient plastic material having a base portion and an upwardly extending reflective portion that will extend up through each and every coating applied to the road surface during the pavement operation. Typically, the base portion has affixed to it an adhesive that holds the temporary pavement marker to the road. They are either manually set in position by someone walking along the road, or by use of some type of mechanical apparatus, which may be towed or driven along the road. The material from which temporary pavement markers are made is not intended to withstand permanent road traffic conditions, and will either be manually torn off, break off because of weather exposure, or will be pulverized by traffic on the resurfaced road. However, they are designed to last long enough for the entire resurfacing project to be completed, and up to and including the repainting of the various traffic lines upon the new surface.

For purposes of illustration in this specification, a chip sealing operation will be described, including the three stages thereof so as to fully understand the prior art and present invention. FIG. 1 shows a prior art temporary road pavement marker that has a base portion to which an adhesive is applied, and an upwardly extending reflective portion having a pair of reflectors attached thereto. Covering the reflective portion of the prior art temporary mark are two layers of clear protective covers. The purpose of these two clear protective covers is to enable the maintenance crew to renew the reflective properties of the temporary road marker between the various coatings that are applied to the road during the chip sealing operation.

In practice, using the prior art, a crew of laborers would, prior to any chip sealing work, lay down the prior art temporary pavement markers over the top of the existing traffic lines. Typically, this is done in a coded fashion to indicate the existence of solid and broken traffic lines, turn lanes, and fog lines. Layers of clear protective covering are left in place. Since the layers of protective covers are clear, oncoming traffic can clearly see the reflective surfaces on the temporary pavement marker.

Next, in a typical chip seal operation, a coating of oil would be applied to the pavement which will coat the pavement and the reflective surfaces of the temporary road marker. This is followed by the deposit and compaction of a layer of chips or gravel, which would seal to the original surface through the base coat of oil. The dust and oil driven up through the chips during this application process will coat the temporary pavement markers and thereby obscure the reflective portion of each temporary pavement marker. If the road were open during construction, the reflective surface would not serve as a substitute for the now obscured and obliterated painted traffic lines. Therefore, in order to restore the reflective properties of the temporary pavement markers, laborers would walk along the road from one temporary pavement marker to the next, stopping at each to peel off the outermost protective cover in order to restore the reflective properties of the temporary pavement markers. This is a labor intensive, time consuming, and therefore an expensive operation. For example, if this were to be done during a typical highway resurfacing of a portion of highway approximately eight miles long, it would take a crew of two people, each working from opposite ends of the resurfacing project and walking inward, approximately eight hours to stoop down and peel off one protective coating from each of the temporary pavement markers along the entire eight miles.

Typically in the chip sealing process, a third coating is applied to the road surface that is a sealing coat of oil or other chemicals that will again obscure the reflective portions of the temporary pavement markers. If there is any time delay between the time that the third and final coat of the chip sealing process is applied and the time that the road lines are repainted, it is again necessary to remove the second and final protective coating from the temporary pavement markers in order to restore the reflectivity of the markers, both for the safety of motorist and to serve as a guide for the paint truck that is soon to follow.

The problem with the prior art is that the reflective paint covers are difficult to peel off. That is not to say that an inappropriate adhesive is used, since once they are peeled back to a point where a finger grip can be made, they can come off easily. But rather it is the fact that there is no easy way to start the peeling in order to obtain an adequate grip. This is especially true for men with large hands and short fingernails, or someone wearing gloves. It is further aggravated during periods of inclement weather when fingers become cold and dexterity is lost.

Accordingly, what is needed is a temporary pavement marker having one or more protective covers with pull-tabs incorporated therein that are easily graspable and thus easily removed with the single pull of one hand. This is an object of the present invention. Another object of the present invention is to utilize a pull-tab for the protective cover that is accessible to someone riding in a slow moving vehicle, low to the ground, where a laborer can reach out and pull off the cover while simultaneously driving or being driven alongside of a row of temporary pavement markers.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

There are two preferred embodiments of the present invention. A first embodiment of the reflective road cover is formed of a body having a base portion and an upwardly extended reflective portion. An adhesive is applied to the base portion of material and designed and configured to adhere to an existing road surface in a position wherein a reflective portion extends upwardly and is visible throughout the resurfacing process.

Attached to the reflective portion are two strips of reflectors, one on each side that are designed to be visible to a motorist and/or someone painting a resurfaced road in both daylight and darkness by reflecting sunlight or headlights. Covering at least a significant portion of the reflective portion and the reflectors is a clear protective cover. Formed integral with the protective cover is a pull-tab that provides easy grasping by an individual to peel off the protective cover if and when it is coated with resurfacing materials to the extent that the reflectors are no longer clearly visible.

In a second preferred embodiment that has essentially the same body section, reflectors, and two protective covers. The second protective cover overlaying the first protective cover. In this case, when the temporary pavement marker becomes obscured with a coating of road surfacing material for the first time, an individual can peel off the second, or outer protective cover, by grasping a pull-tab and ripping it off, thus exposing the untarnished inner protective cover and restoring the reflective properties of the reflectors. After a second coating that obscures the reflective properties of the reflectors is applied, an individual can then grasp the second pull-tab to remove the inner protective cover.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
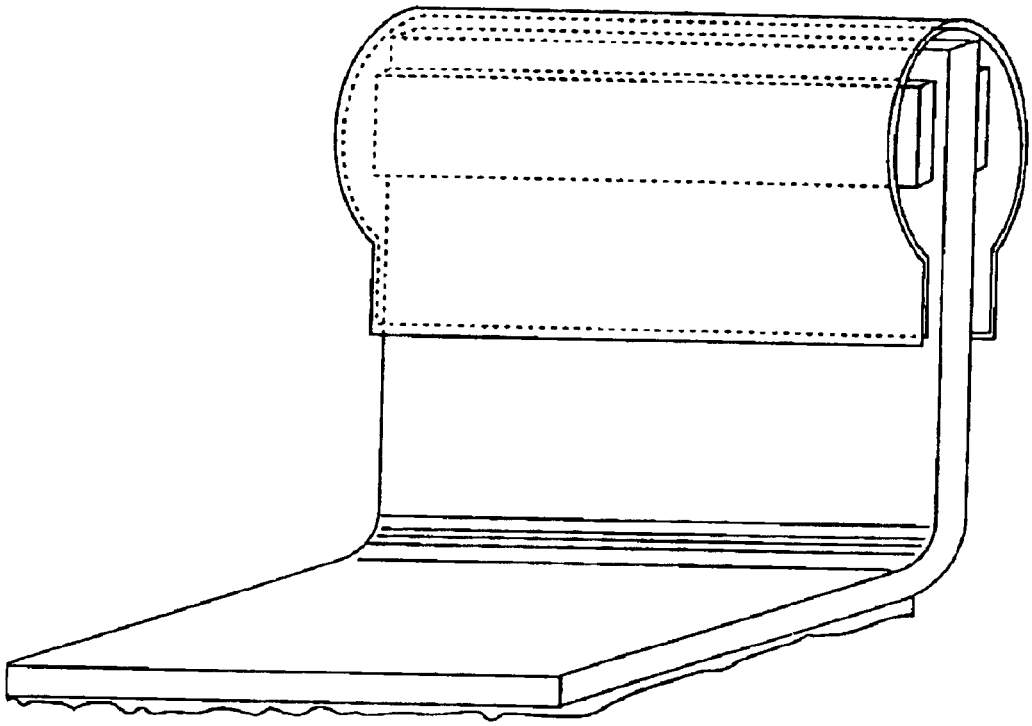
PRIOR ART Fig. 1
FIG. 1 is a perspective representational view of a prior art temporary pavement marker having two protective covers attached thereto it, and covering the reflective portion of the pavement marker.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 2:
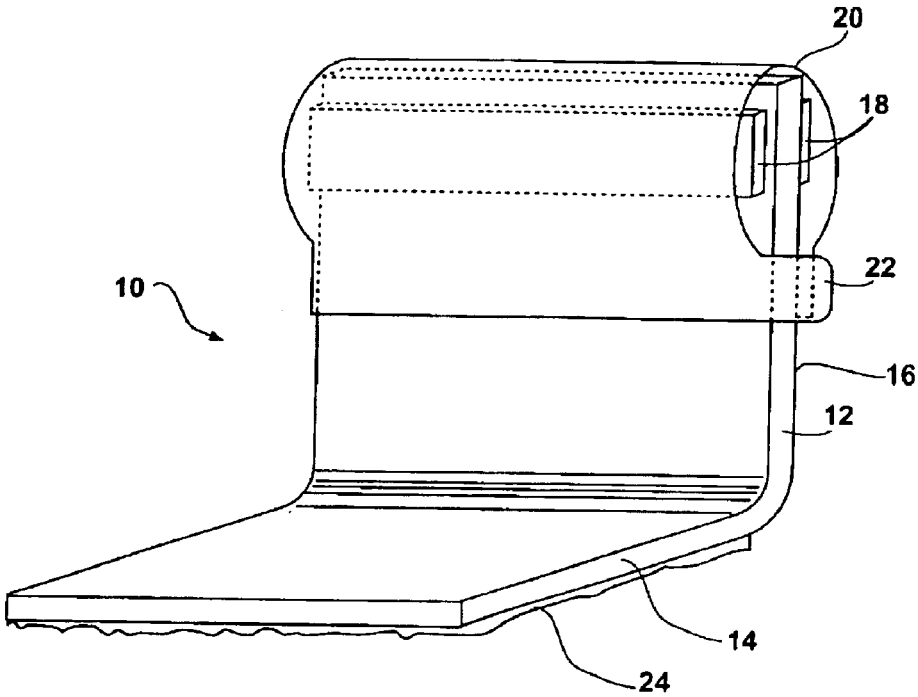
FIG. 2 is a perspective representational view of the new temporary pavement marker having one protective cover installed thereon.
Figure 3:
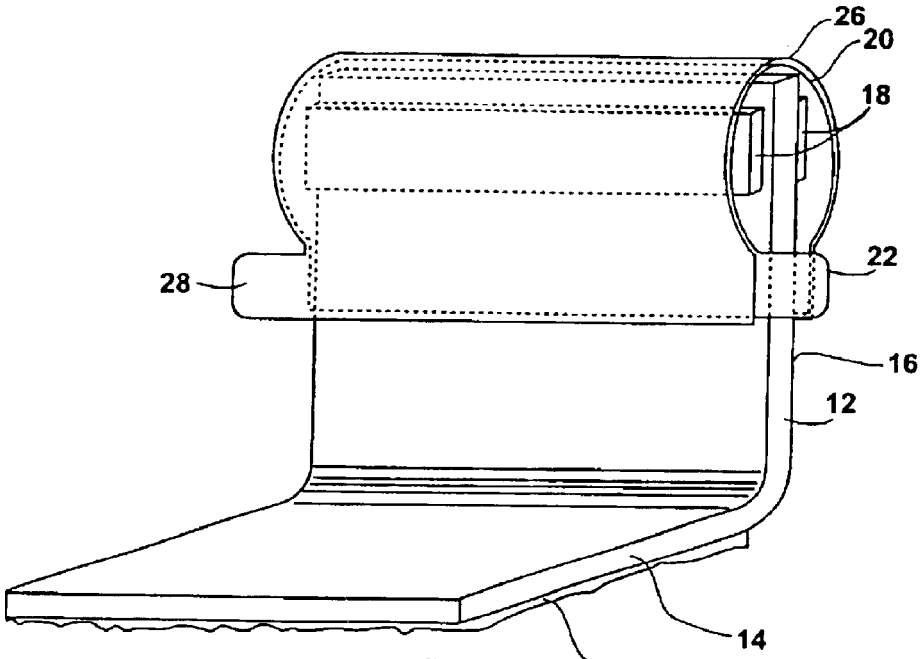
FIG. 3 is a perspective representational view of the new temporary pavement marker having two protective covers installed thereon.

Referring to FIGS. 2 and 3, shown are two preferred embodiments of the present invention. FIG. 2 discloses a first embodiment of reflective road cover 10 that is formed of a body 12 having a base portion 14 and upwardly extended reflective portion 16. An adhesive 24 is applied to base portion 14 of material and designed and configured to adhere to an existing road surface in a position wherein reflective portion 16 extends upwardly and is visible throughout the resurfacing process.

Attached to reflective portion 16 are either one or two strips of reflectors 18, one on each side that are designed to be visible to a motorist and/or someone painting a resurfaced road in both daylight and darkness by reflecting sunlight or headlights. Covering at least a significant section of reflective portion 16 and reflectors 18 is clear, protective cover 20. Formed integral with protective cover 20 is pull-tab 22, which provides easy grasping for an individual to peel off protective cover 20 if and when it is coated with resurfacing materials to the extent that reflectors 18 are no longer clearly visible.

In FIG. 3, there is shown a second preferred embodiment in which is essentially the same body section 12 together with reflectors 18 as shown in FIG. 2, except that two protective covers 20, 26 are provided with second protective cover 26 overlaying first protective cover 20. In this case, when temporary pavement marker 10 becomes obscured with a coating of road surfacing material for the first time, an individual can peel off the second, or outer protective cover 26, by grasping pull-tab 28 and ripping protective cover 26 off, thus exposing the untarnished inner protective cover 20 and restoring the reflective properties of reflectors 18. After a second coating that obscures the reflective properties of reflectors 18 is applied, an individual can then grasp pull-tab 22 to remove inner protective cover 20. Each of the pull-tabs is attached to the accompanying protective cover at a unique location with respect to the other pull-tabs thereby providing a reference to the individual removing the protective covers as to which pull-tab is attached to the outermost protective cover. For example, as shown in FIG. 3, the outermost protective cover 26 has its pull-tab 28 always located on the left hand side of body 12.

There are other variations of locations that can be used for the pull-tabs and the pull-tabs do not have to be oriented horizontally as is shown in this preferred embodiment, for example, both pull-tabs could be located on the same side of the road marker, and could be angled to extend out from the road marker at an angle. The point is that the pull-tabs must be in known, specific locations which is readily accessible to whomever is going to be pulling off the protective coatings.

Also, said pull-tabs can be formed with hole punched through them so as to enable a person to use a tool, such as an elongated hook to grasp the pull-tabs. This enables the person to remove the protective covers without having to reach all the way down to the road surface.

In practice, the incorporation of pull-tabs 22, 28 in protective covers 20, 26 enables an individual to drastically reduce the amount of time and labor necessary to strip off a series of protective covers from temporary pavement markers 10. The use of a simple, common, everyday go-cart enables one laborer to remove a set of protective covers from a set of temporary pavement markers much more quickly, and in fact it has been proven that one individual riding in a go-cart can remove the protective covers from a typical road resurfacing project of eight miles in length in approximately one hour, as opposed to when the prior art markers are used and it takes two people both working a complete eight hour shift to remove the same number of protective covers from pavement markers.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A temporary pavement marker which comprises:

a body having a base portion configured for engagement with a surface of pavement and a reflective portion upwardly extending from said base portion;

an adhesive applied to said base portion for attaching said base portion to said road; and a clear protective cover removably attached to said reflective portion, said clear protective cover having a pull-tab attached thereto for use in removing said clear protective cover from said reflective portion of the temporary pavement marker.

2. A temporary pavement marker which comprises:

a body having a base portion configured for engagement with a surface of pavement and a reflective portion upwardly extending from said base portion;

an adhesive applied to said base portion for attaching said base portion to said road; and a plurality of clear protective covers overlaying and removably attached to said reflective portion, wherein each of said clear protective covers is provided with a pull-tab attached to an edge of said cover for use in sequentially removing said overlaying clear protective covers from said reflective portion of the temporary pavement marker.

3. The temporary pavement marker of claim 2 wherein each of said pull-tabs are each attach to a clear protective cover at a location different from all other of said pull-tabs.

* * * * *